United States Patent [19]

Heusser

[11] Patent Number: 4,811,649

[45] Date of Patent: Mar. 14, 1989

[54] HYDRAULIC CONTROL APPARATUS

[75] Inventor: Martin Heusser, Munich, Fed. Rep. of Germany

[73] Assignee: Heilmeier & Weinlein, Fabrik fur Oelhydraulik GmbH & Co. KG, Fed. Rep. of Germany

[21] Appl. No.: 156,366

[22] Filed: Feb. 16, 1988

[30] Foreign Application Priority Data

Feb. 18, 1987 [DE] Fed. Rep. of Germany ..... 3705170

[51] Int. Cl.[4] ..... F15B 13/02

[52] U.S. Cl. ..... 91/47; 91/443; 91/444; 91/454; 91/459

[58] Field of Search ..... 137/569, 115; 417/440; 91/47, 48, 51, 52, 433, 443, 444, 454, 459, DIG. 2

[56] References Cited

U.S. PATENT DOCUMENTS

| | | | |
|---|---|---|---|
| 2,272,684 | 2/1942 | Vickers | 91/47 |
| 3,125,319 | 3/1964 | Arbogast et al. | 91/48 X |
| 3,561,327 | 2/1971 | Stremple | 137/115 X |
| 4,279,268 | 7/1981 | Aubert | 137/115 |
| 4,409,887 | 10/1983 | Shingu et al. | 91/DIG. 2 |
| 4,727,791 | 3/1988 | Satoh | 91/47 |

FOREIGN PATENT DOCUMENTS

| | | | |
|---|---|---|---|
| 51103 | 4/1980 | Japan | 91/47 |
| 75511 | 6/1980 | Japan | 91/47 |

*Primary Examiner*—Edward K. Look

*Attorney, Agent, or Firm*—Kinzer, Plyer, Dorn, McEachran & Jambor

[57] ABSTRACT

In hydraulic control devices comprising a two-way flow regulator in a reservoir return passage, in which the flow regulator comprises a metering restriction and a pressure equalizer including a control piston with the piston ends disposed in control chambers and subjected to the action of control pressures, the actuation of a single-acting hydraulic motor under load often results in an unavoidable switching shock, because the displacement of the control piston involves the consumption of a certain volume of the pressure fluid. In order to eliminate the switching shock with a simple construction, the end of the control piston subjected to the action of the load pressure is formed as a closure element cooperating with a valve seat in the manner of a poppet valve for holding the load pressure.

12 Claims, 3 Drawing Sheets

HYDRAULIC CONTROL APPARATUS

DESCRIPTION

Figure 1:
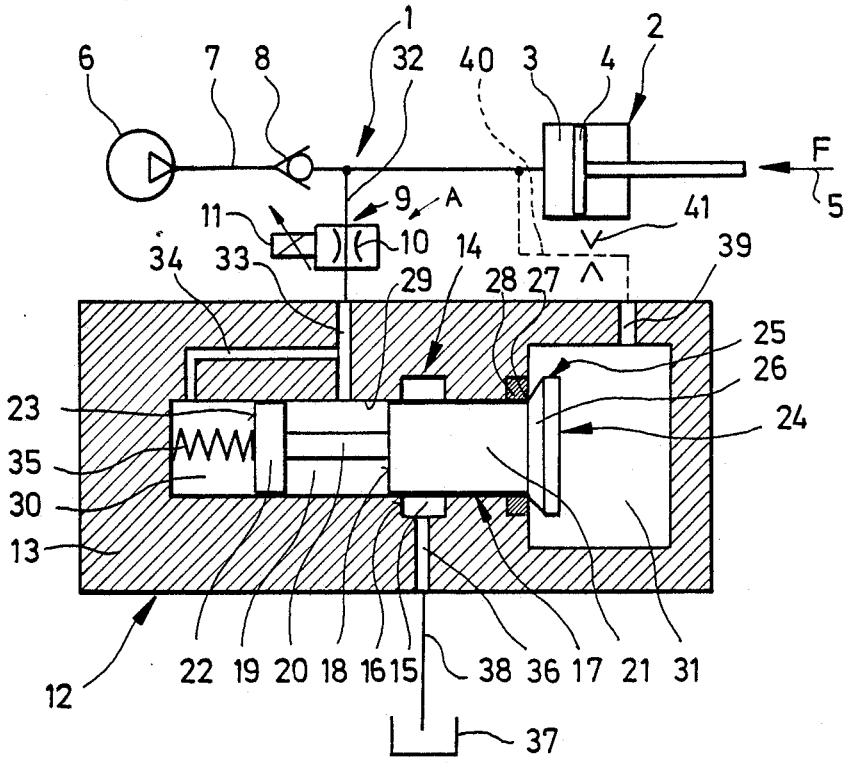

The invention relates to a hydraulic control apparatus of the type defined in the generic clause of claim 1.

A control apparatus of this type has already been proposed in the earlier publication DE-OS No. 35 36 218. The control piston held in the shut-off position by the load pressure for holding the load pressure in the control chamber requires a tight fit and an extended sealing length with an extended positive overlap to achieve a reliable seal and for holding the load pressure downstream of the metering restriction without leakage loss. The pressure equalizer in its zero position has a way-function, because the control chamber housing the other piston end is pressure-relieved by additional valve means. Although in this proposed control apparatus the switching shock is substantially eliminated, this desirable behaviour is only achieved by unacceptable operational and structural complications. In practical use it has been found, moreover, that the still noticeable switching shock is not any more as strong as in the case of previously known control devices according for instance to DE-OS No. 32 33 046, but that under unfavourable conditions it is still noticeable due to the extended positive overlap of the control piston, and also because the pressure equalizer is incapable of holding the load pressure as a result of its construction.

It is an object of the present invention to provide a hydraulic control apparatus of the type defined in the introduction, which is capable of avoiding any switching shock with a technically simple construction.

This object is attained according to the invention by the characterizing features set forth in the characterizing clause of claim 1.

In the control apparatus of this construction, the load pressure in the zero position of the control apparatus is on the one hand absorbed by the shut-off member and thus kept away from the pressure equalizer, and on the other hand by the poppet valve in the control chamber capable in the hold position of the control piston of providing a reliable seal even with a not overly tight fit and a short guided length of the control piston. The metering restriction does not necessarily require any extended positive overlap, because it is not subjected to the load pressure. This results in a compact and simple construction of the pressure equializer with an easily displaceable control piston with a short control stroke. The added expenditure for the poppet valve in the control chamber is negligible.

By this construction it is achieved that on actuation from the zero position, for instance for lowering a lift cylinder, the opening of the metering passage requires only a very short stroke of the control piston, during which the formerly load-holding poppet valve is opened and does then no longer exert any influence on the further control poeration of the control piston. The switching shock is also eliminated due to the fact that in the zero position the control piston remains in the shut-off position, so that no pressure medium is required for displacing it to the shut-off position over a stroke of for instance 10 mm.

From a prospectus RD 09 506 of the firm of Rexroth AG it is known to improve the actuation behaviour of a control apparatus including a pressure equalizer by directly subjecting one end of a control piston to the pump pressure to thereby hold the metering restriction in the shut-off position In this case, however, the control piston cooperates with the housing bore only in the manner of a spool valve, and the control apparatus is only useful for a double-acting hydraulic motor. This implies that the pump has to be operated for movement of the hydraulic motor in both directions and also in the zero position, i.e. particularly also for lowering under load.

An advantageous embodiment is defined in claim 2. In order to keep the load pressure away from the leakage-prone control rectriction of the pressure equalizer, it is only required that the metering restriction forms a tight seal in its shut-off position, for instance by providing it with a poppet valve function. the control apparatus consists only of a small number of components.

In the embodiment according to claim 3 it is possible to employ a conventional metering restriction construction, because in the zero position the load pressure is absorbed by the poppet valves in the return passage an in the control chamber and the control piston remains in its shut-off position without leakage loss.

A further advantageous embodiment of the invention is disclosed in claim 4. In this case the given structural features of the pressure equalizer are used for the construction of the poppet valve between the control piston end and the valve seat. It does not require any extensive additional manufacturing expenditure to form the control piston end with the conical enlargement, and to provide a valve seat adjacent the opening of the housing bore in the control chamber. The valve seat may be formed on an insert member, for instance on a sleeve extending over the full length of the control piston and having its end ground to a conical shape; the conical enlargement may be formed integrally with the control piston or secured thereto as a separate member. In the zero position the pressure fluid is prevented from leaking from the control chamber into the housing bore.

Also of importance is the embodiment according to claim 5, because the provision of the two-position switch valve ensures that the flow resistance of the poppet valve does not influence the control circuit. The pressure equalizer may thus be accurately operable in response to very small differential pressures, although the poppet valve, which is preferably of rather small dimensions, is subjected to a differential pressure which may be many times that acting on the pressure equalizer. This is because the switch valve, when operated, directs the pressure fluid from the control chamber in which the load pressure is held, directly to the other control chamber without passing through the poppet valve. This purpose is also served by the additional control passage bypassing the poppet valve. Without the switch valve it would for instance be necessary to provide a stronger control spring for the pressure equalizer.

Also advantageous is the embodiment according to claim 6, because the poppet valve is automatically brought to its shut-off position by the action of the spring force when the control apparatus is brought to its zero position.

A finely responsive operation and simple actuation are achieved by the embodiment according to claim 7, employing a modern small poppet valve which is inexpensive and requires only a small and inexpensive solenoid for its operation.

The characteristic of claim 8 is advantageous in that the spring force acts to automatically bring the switch valve to its first release position in which the pressure-transmitting connection from the control chamber to the side of the poppet valve facing away from the metering restriction is open, while the load pressure is kept away from the metering restriction and acts directly on the end of the control piston to hold the latter in its hold position.

Also of importance is the concept of claim 9, because a solenoid-operated switch valve may have small dimensions and be inexpensive and reliable in operation.

An advantageous aspect is also disclosed in claim 10, because the interlinking of the actaution means ensures that the shut-off member or poppet valve, respectively, and the switch valve will always simultaneously change their positions when the control apparatus is operated.

A further advantageous embodiment is disclosed by claim 11. The supply passage is only pressurized when the hydraulic motor is to be moved against the load, in which case the metering restriction cooperates with the pressure equalizer to release such an amount of the rpessure fluid towards the reservoir that the speed of movement of the hydraulic motor as set by the metering restriction is maintained irrespective of the load. If a poppet valve is provided, it is in its open position, so that the excess amount of pressure fluid which is prevented from flowing back to the reservoir by the pressure equalizer or additionally provided control means (for instance a further flow regulator), is supplied to the hydraulic motor. If a switch valve is provided in combination with a pressure equalizer for control operation in both direction, both the switch valve and the poppet valve assume a position in which the pressure-transmitting connection from the side of the metering restriction facing towards the poppet valve to the control chamber is open, so that both ends of the control piston are subjected to the action of the pressures upstream and downstream of the metering restriction to thereby adjust the pressure drop to the value set by the metering restriction. If on the other hand a separate flow regulator is provided for the control operation during pressurization of the supply passage, the pressure equalizer remains in the shut-off position.

A further alternative embodiment is finally disclosed by claim 12. In this case, at least one further hydraulic motor is supplied with the rpessure fluid from the supply passage, the movement of this further hydraulic motor being controlled by using the same metering restriction and pressure equalizer as employed for the first hydraulic motor. The hydraulic motor not operated at any given time is separated from the supply passage by its respective poppet valve. Irrespective of this condition, the switch valve ensures that both ends of the control piston of the pressure equalizer are subjected to the action of the pressures existing upstream and downstream of the metering restriction so as to maintain the differential pressure set by the metering restriction independently of variations of the load pressure or the supply pressure. The supply passage may also be connected to further consumers capable of being separately operated via the metering restriction and the pressure equalizer. The control chamber is either supplied with the load pressure from the most heavily loaded hydraulic motor, or in the case of load pressure control passages connected to each hydraulic motor, it is ensured that those control passages are shut off in which the existing load pressures are lower at any given time.

Figure 2:
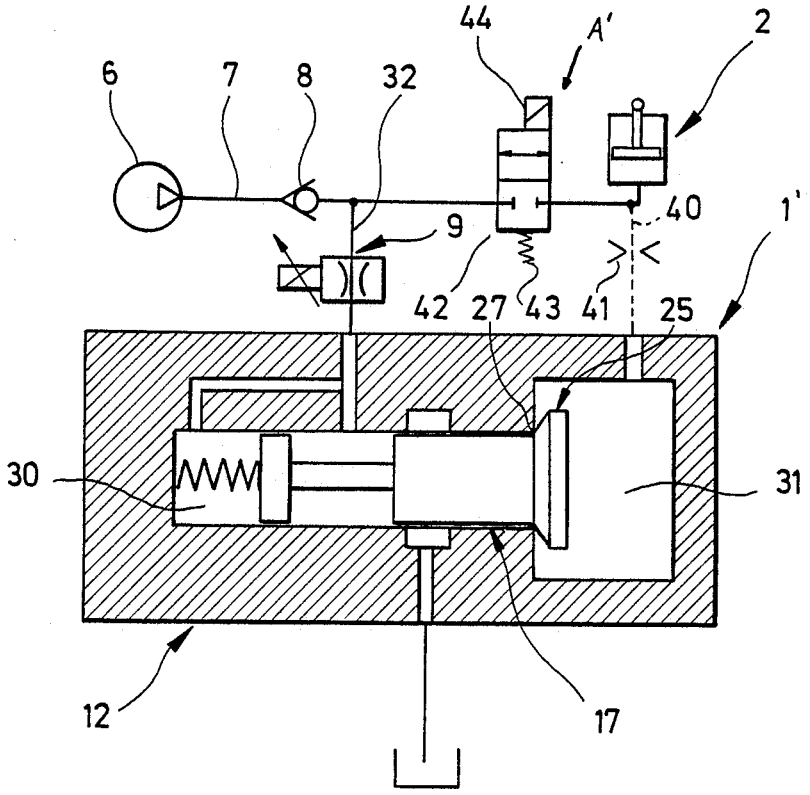
Figure 3:
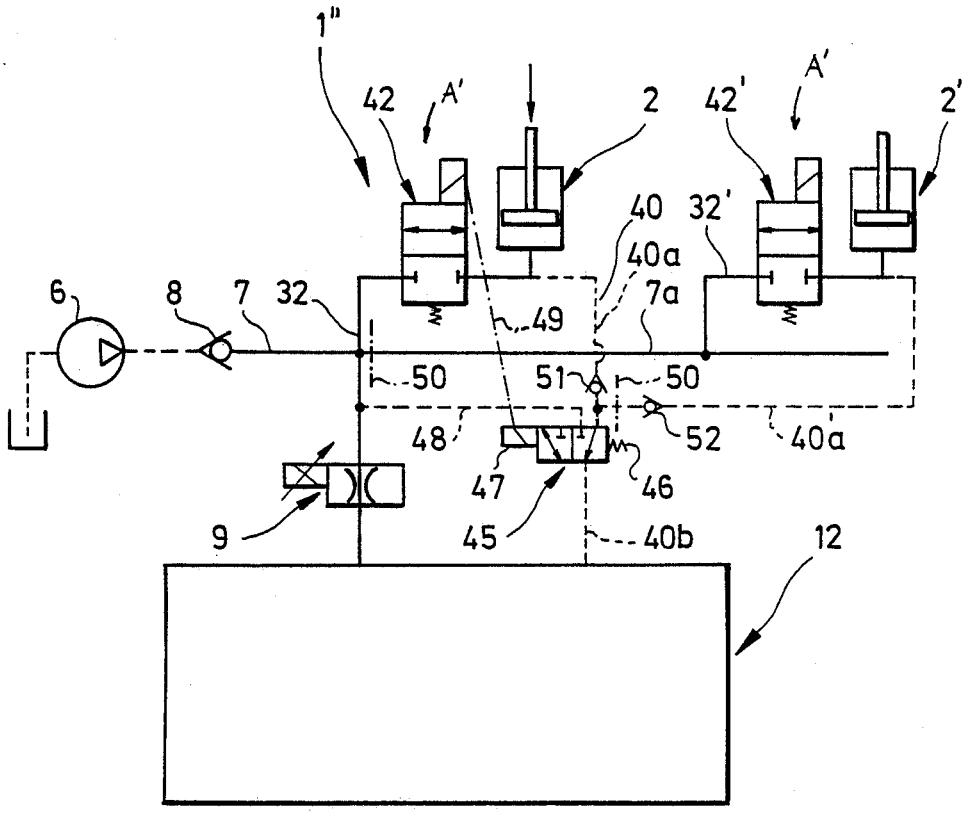

Embodiments of the subject matter of the invention shall now be described by way of example with reference to the accompanying drawings, wherein:

FIG. 1 shows a diagrammatic illustration of a hydraulic control apparatus for a singla-acting hydraulic motor operable against a load, FIG. 2 shows a modified embodiment, and FIG. 3 shows a further embodiment for use with a single hydraulic motor or a plurality of hydraulic motors.

Shown in FIG. 1 is a hydraulic control circuit including a hydraulic control apparatus 1 for a single-acting hydraulic motor 2 operable against a load. The embodiment shown may for instance be a lift control apparatus for the lift piston of a fork lift truck or a loading platform.

Hydraulic motor 2 comprises a cylinder 3 in which a piston 4 is displaceable or hydraulically lockable against a load 5, for instance the weight of the lift fork of a fork lift truck. For the displacement of piston 4 against load 5, cylinder 3 is connected via a non-return valve 8 to a supply passage 7 itself connected to a pressure source 6, for instance a selectively operable hydraulic pump.

Supply passage 7 intersects a return passage 32 from cylinder 3 to a reservoir 37. Disposed in return passage 32 is a metering restriction 9 comprising an adjustable metering restriction member 10 and acting as a shut-off member A adapted to be brought to a load-holding shut-off position by means of an actuator 11, in the present case a solenoid actuator or a proportional solenoid.

Disposed in return passage 32 downstream of metering restriction 9 is a housing 13 of a pressure equalizer 12 containing a control restriction 14 for controlling the differential pressure set in the conventional manner by metering restriction 9, and thus the displacement speed of piston 4. A housing bore 29 is formed with an annular chamber 15 including a control edge 16. A control piston 17 slidably guided in housing bore 29 comprises two piston portions 21 and 22 interconnected by a piston rod 20 defining a restriction 19. One side of piston portion 21 forms a control edge 18 cooperating with control edge 16 in the manner of a shutter during displacement of control piston 17.

The lefthand end 23 of control piston 17 in FIG. 1 is disposed in a control chamber 30 at the lefthand end of housing bore 29. Control chamber 30 contains a regulator spring 35 and communicates with a passage 34 connected to a passage portion 33 of return passage 32 downstream of metering restriction 9 and leading to a center portion of housing bore 29. Passage 33 could also be eliminated if piston end 23 would simultaneously act as control edge 18. In this case the pressure fluid would be permitted to directly escape from control chamber 30 via control restriction 14.

The righthand end 24 of control piston 17 is disposed in a control chamber 31 at the righthand end of housing bore 29, the interior diameter of this control chamber being greater than that of housing bore 29. A passage 39 connects control chamber 31 to a control passage 40 having a restriction 41 disposed therein. Control passage 40 is connected to return passage 32 between hydraulic motor 2 and metering restriction 9 so as to transmit the load pressure existing on the lefthand side of piston 4 to control chamber 31.

The righthand piston end 24 is formed as a closure element 25 comprising a conical enlargement 26. Associated to closure element 25 adjacent the opening of housing bore 29 in control chamber 31 is a valve seat 27 formed in the present example on an insert 28 mounted in housing 13. Insert 28 might also be formed as a hardened sleeve member on which the valve seat is formed by grinding. A passage 36 leads from annular chamber 15 to a reservoir passage 38.

In FIG. 1 control apparatus 1 is in its zero position. Pressure source 6 is deactivated. The pressure exerted by load 5 to act at the lefthand side of piston 4 is held by non-return valve 8, by shut-off member A, i.e. by metering restriction 9 assuming its load-holding shut-off position, and finally by closure element 25 cooperating with valve seat 27 in the manner of a poppet valve. The pressure fluid downstream of metering restriction 9 is pressure-relieved via the closed control restriction 14 (structurally inavoidable leakage losses). Control piston 17 is thus prevented from leaving its shut-off position.

A displacement of piston 4 against load 5 is initiated by activation of pressure source 6. As long as for this direction of movement there is not provided a separate control device disposed for instance between pump 6 and non-return valve 7, solenoid 11 is operated to adjust metering restriction 9 to an open position corresponding to the desired displacement speed of piston 4. Metering restriction 9 thus loses its function as shut-off member A. Control chamber 30 is pressurized until control piston 17 is displaced to the right to release the pressure fluid through control restriction 16, 18 at a rate permitting piston 4 to be displaced to the right only at the selected speed irrespective of the magnitude and/or variations of load 5. A switching shock is avoided in this case, because non-return valve 8 opens only after at least the same pressure as that existing in control chamber 31 has been built up in supply passage 7, and because the pressure medium for the displacement of control piston 17 is supplied from pressure source 6.

If piston 4 is to be displaced under load 5 to the left in FIG. 1, proceeding from the zero position, pressure source 6 is not activated. Only metering restriction 9 is adjusted to a position corresponding to the desired displacement speed of piston 4. Metering restriction thus abandons its function as shut-off member A. Pressure fluid under load pressure is displaced from control chamber 31 via control passage 40 and passages 33 and 34 into control chamber 30, so that control restriction 14 opens. As there is no substantial positive overlap between control edges 18 and 16 is required, because the load pressure was held by shutoff member A, the opening of control restriction 14 does not require any noticeable amount of pressure fluid. Due to the additional action of control spring 35, control piston 17 is displaced to the right, causing a corresponding volume of the pressure fluid to be displaced from control chamber 31 into control chamber 30. For this reason a switching shock is eliminated.

As it is difficult in practice to design metering restriction 9 as shown in FIG. 1 in such a manner that it is able to operate as a shut-off member A in its closed position, the embodiment shown in FIG. 2 comprises a shut-off valve 42 disposed between hydraulic motor 2 and metering restriction 9. Valve 42 is biased towards its closed position by a spring 43 and operable to open by means of an actuator 44, for instance a switching solenoid. In its closed position valve 42 acts as shut-off member A'. Control passage 40 is connected to return passage 32 between shut-off valve 42 and hydraulic motor 2. In the zero position of control apparatur 1', the pressure equalizer 12 of which corresponds to that of FIG. 1, the load pressure of hydraulic motor 2 is thus held by shut-off valve 42 and closure element 25 on its valve seat 27. Metering restriction 9 may thus be left open in the zero position. This implies that metering restriction 9 may be very finely adjusted in the case for instance of a loading blatform control apparatus with a constant speed of hydraulic motor 2.

For moving hydraulic motor 2 against the load, pressure source 6 is activated and shut-off valve 42 is switched to its open position. The piston of hydraulic motor 2 is subsequently moved against the load in response to the adjustment of metering restriction 9. The displacement of control piston 17 causes a corresponding volume of the pressure fluid to be displaced from control chamber 31 into control chamber 30. A switching shock does not occur. If a separate control device is employed for movement in this direction, disposed for instance between pressure source 6 and non-return valve 7, metering restriction 9 is maintained in the closed position, and pressure equalizer 12 remains inoperative.

If piston H of hydraulic motor 2 is to be moved under the bias of the load, pressure source 6 is not activated, and shut-off valve 42 is switched to its open position. Depending on the adjustment of metering restriction 9, control piston 17 is displaced to the right, causing a corresponding volume of the pressure fluid to be displaced under load pressure from control chamber 31 into control chamber 30. A switching shock does therefore not occur.

In the embodiment of the control apparatus 1'' as shown at the central portion of FIG. 3, the same pressure equalizer 12 is employed as in the embodiments of FIGS. 1 and 2. Metering restriction 9 may be adjustable or adjusted to a fixed setting. Control apparatus 1'' according to FIG. 3 additionally includes a two-position switch valve 45 disposed in control passage 40 connected to return passage 32 between shut-off valve 42 and hydraulic motor 2 so as to be always under the load pressure. Control passage 40 has two sections **40*a* and 40*b* with switch valve 45 disposed therebetween. A second control passage 48 is connected to return passage 32 between metering restriction 9 and shut-off valve 42 on the one hand, and to switch valve 45 on the other. A spring 46 acts to bias switching valve 45 to a first release position in which the two sections 40*a* and 40*b* of control passage 40 communicate with one another and second control passage 48 is shut off. An actuator 47, for instance a switching solenoid, is operable to actuate switching valve 45 to a second release position in which pressure-transmitting communication is established between section 40*b* of control passage 40 and second control passage 48, while first section 40*a* of control passage 40 is shut off. The actuators of shut-off valve 42 and switching valve 45 may be interlinked by coupling means 49** for simultaneous operation.

With switching valve 45 and second control passage 48 it is ensured that the flow resistance of shut-off valve 42 does not influence the control circuit of control apparatus 1'', and that in the open position of the shut-off valve the same pressure exists in control chamber 31 as in return passage 32 between metering restriction 9 and shut-off valve 42.

For moving hydraulic motor 2 against the load, pressure source 6 is activated, and metering restriction 9 is adjusted to the desired speed of movement. The control piston is held in its closure position by the load pressure in control passage 40. Subsequently shut-off valve 42 and switching valve 45 are simultaneously operated via coupling means 49, so that shut-off valve 42 is brought to its open position and switch valve 45 to its second release position in which section 40*b* of control passage 40 communicates with second control passage 48 while section 40*a* of control passage 40 is shut off. Shortly before the pressure in control chamber 30 reaches the load pressure, control piston 17 is displaced to the right, so that the control restriction is gradually opened. This movement of control piston 17 causes a corresponding volume of the pressure fluid to be displaced from control chamber 31 through passage section 40,, switching valve 45, control passage 48 and return passage 32 into control chamber 30, thus reliably eliminating any switching shock. If a separate control device is provided for this direction of movement, for instance a flow regulator, pressure equalizer 12 remains inoperative. the respective load pressure is held in the zero position.

For movement of hydraulic motor 2 with the load, departing from the zero position, shut-off valve 42 is brought to its open position, and switching valve 45 is actuated to its second release position, so that the pressures upstream and downstream of metering restriction 9 act in control chambers 30 and 31, respectively, and the flow resistance of shut-off valve 42 does not influence the control operation.

The control restriction 14 is actuated in response to the adjustment of metering restriction 9. The displacement of control piston 17 causes a corresponding volume of the pressure fluid to be displaced from control chamber 31 into control chamber 30. A switching shock does not occur.

For regaining the zero position, shut-off valve 42 is operated simultaneously with switching valve 45. The load pressure is then again held by shut-off valve 42 and the poppet valve formed by closure element 25 and valve seat 27. Second control passage 48 is shut off. Control chamber 30 is pressure-relieved via control restriction 14.

As indicated in FIG. 3, control apparatus 1'' may be transforemd to a control apparatus 1''' by the addition of at least one further hydraulic motor 2'. This control apparatus 1 is operable to control a plurality of hydraulic motors 2, 2' independently of the load pressure by using a common metering restriction 9, a common pressure equalizer 12, and a common switching valve 45. The additional hydraulic motor 2' is connected to supply passage 7 through its return passage 32'. Disposed in return passage 32' is a shut-off valve 42' corresponding to shut-off valve 42 for holding the load pressure of hydraulic motor 2' in its shut-off position and for permitting the pressure fluid to be supplied to or drained from hydraulic motor 2' in its open position. A control passage section 40*a'* corresponding to section 40*a* of control passage 40 may lead from a position of resturn passage 32' between shut-off valve 42' and hydraulic motor 2' to passage section 40*a* and thus to switching valve 45. Control passage sections 40*a* and 40*a'* are suitable provided with non-return valves 51, 52. Dash-dotted lines 50 indicate the locations for connection of hydraulic motor 2' and any additional hydraulic motors. If hydraulic motor 2 operates at the highest load pressure, control passage section 40*a'* may be eliminated.

Hydraulic motors 2, 2' are preferably separately operated, i.e. one motor remains in its load-holding position while the other is operated.

The particular advantage of the various embodiments of the control apparatus 1, 1'', 1''' lies in the fact that switching of the control apparatus from its zero position to a position for moving the hydraulic motor under load does not cause a switching shock to occur, because the poppet valve formed in the pressure equalizer between closure member 25 and valve seat 27 is substantially leak-proof, so that no pressure fluid is lost even over extended stationary periods. At the start of the movement, the accurate volume of the pressure fluid required for opening the control restriction is displaced from the control chamber containing the poppet valve into the other control chamber, so that any undesireable switching shock is avoided. This volume is thus held in readiness under load pressure in a pressure accumulator integrated in the control apparatus without contribution of the pressure source.

I claim:

1. A hydraulic control apparatus (1, 1', 1''), particularly lift control apparatus for at least one single-acting hydraulic motor (2, 2') adapted to lift a load (5), to carry the load under stationary conditions, and to be operable in opposite directions under said load, comprising a two-way flow regulator disposed in a return passage (32) leading to a reservoir (37), said flow regulator comprising a metering restriction (9) and a pressure equalizer (12) including a variable restriction (14) controlled by a control piston (17) mounted in a housing bore (29) for displacement between a release position and a hold position, the ends (23, 24) of said piston being disposed in two control chambers.(31, 30) of which the control chamber (30) containing the piston end (23) to be acted on in the direction towards the release position of said control piston is supplied with the pressure prevailing downstream of said metering restriction (9), while the control chamber (31) containing the piston end to be acted on in the direction towards the hold position of said control piston is supplied with the pressure prevailing upstream of said metering restriction (9), characterized in that the piston end (24) of said control piston (17) adapted to be acted on by said pressure prevailing upstream of said metering restriction (9) is provided with a closure element (25), that said closure element (25) has a valve seat (27) associated therewith in said control chamber (31), that said closure element (25) sealingly cooperates with said valve seat (27) in the manner of a poppet valve in the hold position of said control piston (17), and that said return passage (32) is provided with a shut-off member (A, A') adapted to be actuated to a load pressure holding shut-off position.

2. A hydraulic control apparatus (1, 1', 1'') according to claim 1, characterized in that said shut-off member (A) is said metering restriction (9) adapted to be adjusted to a sealing shut-off state.

3. A hydraulic control apparatus according to claim 1, characterized in that said shut-off member (A') is a poppet valve (42, 42') disposed upstream of said metering restriction (9), and that said control chamber (31) communicates with said return passage (32) at the side of said poppet valve (42, 42') facing away from said metering restriction.

4. A hydraulic control apparatus according to claim 1, characterized in that said control chamber (31) has its inner diameter enlarged relative to that of said housing bore (29), that said valve seat (27) is of conical shape and located adjacent the transition from said housing bore (29) to said control chamber (31), and that said closure element (25.1 is formed by a conically enlarged portion (26) at the control piston end (24).

5. A hydraulic control apparatus according to claim 1, characterized in that a first control passage (4C) for transmitting the pressure prevailing at the side of said poppet valve (42) facing away from said metering restriction (9) to said control chamber (31) is provided with a two-position switch valve (45) and that a further control passage (48) leads from said switch valve (45) to said return passage (32) upstream of said metering restriction (9).

6. A hydraulic control apparatus according to claim 3, characterized in that said poppet valve (42, 42') is adapted to be actuated against a spring bias from its shut-off position to a release position.

7. A hydraulic control apparatus according to claim 6, characterized in that said poppet valve (42, 42') is solenoid-operated.

8. A hydraulic control apparatus according to claim 5, characterized in that said switch valve (45) is adapted to be actuated against a spring bias from a first release position, in which said first control passage (40) communicates with said control chamber (31), to a second release position, in which said control chamber (31) communicates with said second control passage (48).

9. A hydraulic control apparatus according to claim 8, characterized in that said switch valve (45) is solenoid-operated.

10. A hydraulic control apparatus according to claim 2, characterized in that the actuating means (47, 44) of said shut-off member (A, A') (e.g. poppet valve 42) and of said switch valve (45) are interlinked (49) for operating in unison.

11. A hydraulic control apparatus according to claim 1 characterized in that upstream of said metering restriction (9) said return passage (32) intersects with a supply passage (7) for a single-acting load-supporting hydraulic motor (2), said supply passage being pressurized by a pressure source (6).

12. A hydraulic control apparatus according to claim 11, characterized in that said supply passage (7) intersects at least one further return passage (32') of a further single-acting load-supporting hydraulic motor (2') for which a further poppet valve (42') is provided in said further return passage (32'), and that between said poppet valve 42') and said further hydraulic motor (2') a control passage (40'a) is optionally provided leading to said switch valve (45) common to all existing hydraulic motors (2, 2').

* * * * *